US008329631B2

(12) United States Patent
Buisker et al.

(10) Patent No.: US 8,329,631 B2
(45) Date of Patent: Dec. 11, 2012

(54) HAND DISHWASHING DETERGENT

(75) Inventors: Detlef Buisker, Essen (DE); Heinz-Dieter Soldanski, Essen (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 13/216,436

(22) Filed: Aug. 24, 2011

(65) Prior Publication Data

US 2011/0312868 A1 Dec. 22, 2011

Related U.S. Application Data

(63) Continuation of application No. PCT/EP2010/051948, filed on Feb. 17, 2010.

(30) Foreign Application Priority Data

Feb. 26, 2009 (DE) ..... 10 2009 001 186

(51) Int. Cl.

| | |
|---|---|
| ***C11D 1/29*** | (2006.01) |
| ***C11D 1/66*** | (2006.01) |
| ***C11D 1/88*** | (2006.01) |
| ***C11D 1/94*** | (2006.01) |

(52) U.S. Cl. ..... 510/238; 510/235; 510/236; 510/423; 510/434; 510/427; 510/428; 510/435; 510/492; 510/499; 510/509

(58) Field of Classification Search ..... 510/235, 510/236, 238, 423, 434, 427, 428, 435, 492, 510/499, 509

See application file for complete search history.

(56) References Cited

U.S. PATENT DOCUMENTS

| | | | | |
|---|---|---|---|---|
| 6,037,316 | A | 3/2000 | Garner et al. | |
| 7,393,820 | B2 * | 7/2008 | Soldanski et al. | 510/483 |

FOREIGN PATENT DOCUMENTS

| | | | |
|---|---|---|---|
| DE | 10023438 | A1 | 11/2001 |
| DE | 102005031193 | A1 | 1/2007 |
| EP | 0334566 | B1 | 8/1994 |
| EP | 0958340 | B1 | 7/2003 |
| WO | WO 2007/085410 | A1 | 8/2007 |

OTHER PUBLICATIONS

PCT International Search Report (PCT/EP2010/051948) dated May 17, 2010.

* cited by examiner

*Primary Examiner* — Gregory Delcotto
(74) *Attorney, Agent, or Firm* — David K. Benson

(57) ABSTRACT

An aqueous cleaning agent for hard surfaces which contains a surfactant combination of fatty alcohol ether sulfate and at least one further surfactant together with 10 to 40 wt. % of a water-soluble salt, may be used for manual dishwashing and is above all suitable for removing stubborn, burnt-on or dried-on soiling while being gentle on the skin.

8 Claims, No Drawings

HAND DISHWASHING DETERGENT

CROSS-REFERENCES TO RELATED APPLICATIONS

This application is a continuation of PCT/EP2010/051948, filed on Feb. 17, 2010, which claims priority under 35 U.S.C. §119 to DE 10 2009 001 186.2 filed on Feb. 26, 2009.

FIELD OF THE INVENTION

The present invention generally relates to an aqueous cleaning agent for hard surfaces which contains a surfactant combination of fatty alcohol ether sulfate and at least one further surfactant together with 10 to 40 wt. % of a water-soluble salt. This cleaning agent is preferably used for manual dishwashing.

BACKGROUND OF THE INVENTION

Liquid aqueous manual dishwashing agents are used in countless households. However, in particular with stubborn, encrusted or baked-on soiling, they reach their limits of usability because relatively long softening times and the application of fairly substantial mechanical forces are required in order to achieve a satisfactory cleaning result. If rapid cleaning is desired, further cleaning agents are accordingly used, for instance more strongly alkaline cleaning sprays or scouring agents. However, this is desirable from neither an economic nor an environmental standpoint. A further problem is the limited skin compatibility both of many conventional manual dishwashing agents and of the additionally used cleaning agents.

It has surprisingly now been found that an aqueous cleaning agent which contains a specific surfactant mixture and additionally has an elevated concentration of common salt, above the saturation point thereof, on the one hand, due to the abrasive action of the undissolved salt crystals, exhibits particularly good cleaning performance especially on stubborn soiling and, on the other hand, possesses very good skin compatibility even when only slightly diluted.

Water-soluble salts have long been used in cleaning agents for hard surfaces, for example for adjusting viscosity or as components of buffer systems. Suspended salt particles have, however, already also been used as abrasives. WO 2007/085410 A1 accordingly proposes a cleaning agent composition in which salt particles may be suspended thanks to an internal structure. The surfactant combination of fatty alcohol ether sulfate and at least one further surfactant is, however, not claimed therein. This agent was not observed to be gentle on the skin; cleaning performance on encrusted soiling is described as "satisfactory".

EP 958340 B1 claims a surfactant-containing antibacterial cleaning composition with abrasive particles, which should preferably be salts. This agent should, however, contain no anionic surfactants. Good cleaning performance on baked-on greasy soiling was not found nor was the agent observed to be gentle on the skin.

The present invention accordingly provides an aqueous cleaning agent for hard surfaces which contains a surfactant combination of fatty alcohol ether sulfate and betaine surfactant and 10 to 40 wt. % of a water-soluble salt.

This cleaning agent is above all suitable as a manual dishwashing agent with which even stubborn, burnt-on or dried-on soiling may readily be removed. The present application accordingly also provides the use of the cleaning agent according to the invention for manual dishwashing.

The cleaning agent according to the invention furthermore has the advantage that it is washed out of a sponge more slowly than a comparable formulation with a smaller quantity of salt. Long retention in the sponge is in particular advantageous if the items to be washed are being cleaning under running water, since lower losses occur and thus greater efficiency is achieved.

Furthermore, other desirable features and characteristics of the present invention will become apparent from the subsequent detailed description of the invention and the appended claims, taken in conjunction with the accompanying drawings and this background of the invention.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

For the purposes of the present invention, unless otherwise stated, fatty acids or fatty alcohols or the derivatives thereof are representative of branched or unbranched carboxylic acids or alcohols or the derivatives thereof having preferably 6 to 22 carbon atoms. The former, being plant-based and derived from renewable raw materials, are in particular preferred for environmental reasons, but the teaching according to the invention is not limited thereto. In particular, oxo alcohols obtainable by Roelen's oxo synthesis or the derivatives thereof may for example also be put to corresponding use.

Whenever alkaline earth metals are mentioned below as counterions for monovalent anions, this means that the alkaline earth metal is, of course, only present in half the molar quantity (sufficient for charge balancing) as the anion.

Substances which also serve as ingredients in cosmetics are, where applicable, named in accordance with the International Nomenclature of Cosmetic Ingredients (INCI). Chemical compounds have an INCI name in English, plant ingredients are only listed in Latin using the Linnaean classification, while "common" names such as "water", "honey" or "sea salt" are likewise stated in Latin. INCI names may be found in the "International Cosmetic Ingredient Dictionary and Handbook, Seventh Edition (1997)" which is published by The Cosmetic, Toiletry and Fragrance Association (CTFA), 1101, 17th Street NW, Suite 300, Washington, D.C. 20036, USA, and contains more than 9,000 INCI names and references to more than 37,000 trade names and technical terms including the associated distributors from more than 31 countries. The International Cosmetic Ingredient Dictionary and Handbook assigns the ingredients one or more chemical classes, for example "Polymeric Ethers", and one or more functions, for example "Surfactants—Cleansing Agents", which it in turn explains in greater detail and to which, where applicable, reference is made below.

The abbreviation CAS means that the following sequence of numbers is a Chemical Abstracts Service number.

Unless explicitly stated otherwise, the quantities stated in weight percent (wt. %) relate to the entire agent. These percentage quantities here relate to active contents.

Surfactants

The agent according to the invention contains surfactants in a total quantity of conventionally 7 to 40 wt. %, preferably of 12 to 35 wt. %, in particular of 16 to 25 wt. %. The surfactants comprise a surfactant combination of fatty alcohol ether sulfate and at least one further surfactant.

In addition to alkyl ether sulfates, the agent according to the invention may therefore additionally contain one or more further anionic surfactants, amphoteric surfactants, nonionic surfactants and/or cationic surfactants, in particular for improving cleaning action, draining behavior and/or drying behavior. It is particularly preferred for the further surfactant to be selected from the group comprising nonionic surfactants, in particular fatty alcohol polyglycol ethers, betaine surfactants, secondary alkanesulfonates and mixtures thereof.

The alkyl ether sulfates and alkylsulfonates together with the further anionic surfactants are conventionally used as an alkali metal, alkaline earth metal and/or mono-, di- or trialkanolammonium salt and/or alternatively also in the form of the corresponding acid thereof to be neutralized in situ with the corresponding alkali metal hydroxide, alkaline earth metal hydroxide and/or mono-, di- or trialkanolamine. Preferred alkali metals are here potassium and in particular sodium, while preferred alkaline earth metals are calcium and in particular magnesium, and preferred alkanolamines are mono-, di- or triethanolamine. Sodium salts are particularly preferred.

Alkyl Ether Sulfates

Alkyl ether sulfates (fatty alcohol ether sulfates, INCI Alkyl Ether Sulfates) are products of sulfation reactions on alkoxylated alcohols. A person skilled in the art generally takes alkoxylated alcohols to be the reaction products of alkylene oxide, preferably ethylene oxide, with alcohols, for the purposes of the present invention preferably with longer-chain alcohols, i.e. with aliphatic straight-chain or mono- or poly-branched, acyclic or cyclic, saturated or mono- or polyunsaturated, preferably straight-chain, acyclic, saturated, alcohols with 6 to 22, preferably 8 to 18, in particular 10 to 16 and particularly preferably 12 to 14 carbon atoms. In general, n moles of ethylene oxide and one mole of alcohol give rise, depending on the reaction conditions, to a complex mixture of addition products of differing degrees of ethoxylation (n=1 to 30, preferably 1 to 20, in particular 1 to 10, particularly preferably 2 to 4). A further embodiment of alkoxylation involves the use of mixtures of alkylene oxides, preferably a mixture of ethylene oxide and propylene oxide. Low-ethoxylated fatty alcohols with 1 to 4 ethylene oxide units (EO), in particular 1 to 2 EO, for example 2 EO, such as Na $C_{12-14}$ fatty alcohol+2EO sulfate are very particularly preferred for the purposes of the present invention.

In a preferred embodiment, the agent according to the invention contains one or more alkyl ether sulfates in a quantity of 5 to 20 wt. %, preferably of 8 to 16 wt. %.

Betaines

Suitable betaines are alkylbetaines, alkylamidobetaines, imidazoliniumbetaines, sulfobetaines (INCI Sultaines) and phosphobetaines and preferably comply with the formula I, $$R^1—[CO—X—(CH_2)_n]_x—N^+(R^2)(R^3)—(CH_2)_m—[CH(OH)—CH_2]_y—Y^- \quad (I)$$

in which $R^1$ is a saturated or unsaturated $C_{6-22}$ alkyl residue, preferably $C_{8-18}$ alkyl residue, in particular a saturated $C_{10-16}$ alkyl residue, for example a saturated $C_{12-14}$ alkyl residue, X is NH, $NR^4$ with the $C_{1-4}$ alkyl residue $R^4$, O or S, n is a number from 1 to 10, preferably 2 to 5, in particular 3, x is 0 or 1, preferably 1, $R^2$, $R^3$ are mutually independently a $C_{1-4}$ alkyl residue, optionally hydroxy-substituted such as for example a hydroxyethyl residue, but in particular a methyl residue, m is a number from 1 to 4, in particular 1, 2 or 3, y is 0 or 1 and Y is COO, $SO_3$, $OPO(OR^5)O$ or $P(O)(OR^5)O$, in which $R^5$ is a hydrogen atom H or a $C_{1-4}$ alkyl residue.

The alkyl- and alkylamidobetaines, betaines of formula I with a carboxylate group ($Y^-$=$COO^-$), are also designated carbobetaines.

Preferred betaines are alkylbetaines of the formula (Ia), alkylamidobetaines of the formula (Ib), sulfobetaines of the formula (Ic) and amidosulfobetaines of the formula (Id), $$R^1—N^+(CH_3)_2—CH_2COO^- \quad (Ia)$$

$$R^1—CO—NH—(CH_2)_3—N^+(CH_3)_2—CH_2COO^- \quad (Ib)$$

$$R^1—N^+(CH_3)_2—CH_2CH(OH)CH_2SO_3^- \quad (Ic)$$

$$R^1—CO—NH—(CH_2)_3—N^+(CH_3)_2—CH_2CH(OH)CH_2SO_3^- \quad (Id)$$

in which $R^1$ has the same meaning as in formula I

Particularly preferred betaines are carbobetaines, in particular carbobetaines of the formula (Ia) and (Ib), extremely preferably alkylamidobetaines of the formula (Ib).

One preferred betaine is for example cocamidopropyl betaine (cocamidopropylbetaine).

The agent according to the invention contains one or more betaines in a quantity of conventionally 1 to 10 wt. %, preferably of 2 to 8 wt. %.

Alkylsulfonates

The agents according to the invention preferably furthermore contain one or more alkylsulfonates. Alkylsulfonates (INCI Sulfonic Acids) conventionally comprise an aliphatic straight-chain or mono- or poly-branched, acyclic or cyclic, saturated or mono- or polyunsaturated, preferably branched, acyclic, saturated, alkyl residue with 6 to 22, preferably 9 to 20, in particular 11 to 18 and particularly preferably 14 to 17 carbon atoms.

Suitable alkylsulfonates are accordingly saturated alkanesulfonates, unsaturated olefin sulfonates and ether sulfonates, which are formally derived from the alkoxylated alcohols on which the alkyl ether sulfates are also based, a distinction being drawn between terminal ether sulfonates (n-ether sulfonates) with a sulfonate function attached to the polyether chain and internal ether sulfonates (i-ether sulfonates) with the sulfonate function linked with the alkyl residue.

Alkanesulfonates are preferred according to the invention, in particular alkanesulfonates with a branched, preferably secondary, alkyl residue, for example the secondary alkanesulfonate sec. Na—$C_{13-17}$-alkanesulfonate (INCI Sodium C14-17 Alkyl Sec Sulfonate).

The agent according to the invention preferably contains one or more secondary alkanesulfonates in a quantity of conventionally 1 to 10 wt. %, preferably of 2 to 8 wt. %.

When using a surfactant combination of a) alkyl ether sulfate, b) betaine and optionally c) secondary alkanesulfonate, these are preferably present in a ratio of a):b):c) of 2:1:0 to 5:1:1.

Nonionic Surfactants

The agent according to the invention may additionally contain one or more nonionic surfactants, conventionally in a quantity of 0.001 to 10 wt. %, preferably of 0.01 to 6 wt. %, in particular of 0.1 to 4 wt. %, particularly preferably of 0.2 to 2 wt. %.

Nonionic surfactants for the purposes of the invention are alkoxylates such as polyglycol ethers, fatty alcohol polyglycol ethers, alkylphenol polyglycol ethers, end group-terminated polyglycol ethers, mixed ethers and hydroxy mixed ethers and fatty acid polyglycol esters. Block polymers prepared from ethylene oxide and propylene oxide together with fatty acid alkanolamides and fatty acid polyglycol ethers are likewise suitable. Further important classes of nonionic surfactants according to the invention are amine oxides and sugar surfactants, in particular alkyl polyglucosides.

Fatty Alcohol Polyglycol Ethers

According to the invention, fatty alcohol polyglycol ethers should be taken to mean unbranched or branched, saturated or unsaturated $C_{10-22}$ alcohols alkoxylated with ethylene oxide (EO) and/or propylene oxide (PO) and with a degree of alkoxylation of up to 30, preferably ethoxylated $C_{10-18}$ fatty alcohols with a degree of ethoxylation of less than 30, preferably of 1 to 20, in particular of 1 to 12, particularly preferably of 1 to 8, extremely preferably of 2 to 5, for example $C_{12-14}$ fatty alcohol ethoxylates with 2, 3 or 4 EO or a mixture of $C_{12-14}$ fatty alcohol ethoxylates with 3 and 4 EO in a weight ratio of 1:1 or isotridecyl alcohol ethoxylate with 5, 8 or 12 EO.

Amine Oxides

Amine oxides which are suitable according to the invention include alkylamine oxides, in particular alkyldimethylamine oxides, alkylamidoamine oxides and alkoxyalkylamine oxides. Preferred amine oxides comply with the formula II, $$R^6R^7R^8N^+—O^- \quad (II)$$

$$R^6—[CO—NH—(CH_2)_w]_z—N^+(R^7)(R^8)—O^- \quad (II)$$

in which $R^6$ is a saturated or unsaturated $C_{6-22}$ alkyl residue, preferably $C_{8-18}$ alkyl residue, in particular a saturated $C_{10-16}$ alkyl residue, for example a saturated $C_{12-14}$ alkyl residue, which, in the alkylamidoamine oxides, is attached to the nitrogen atom N via a carbonylamidoalkylene group —CO—NH—$(CH_2)_z$— and, in the alkoxyalkylamine oxides, via an oxyalkylene group —O—$(CH_2)_z$—, z in each case denoting a number from 1 to 10, preferably from 2 to 5, in particular 3, $R^7$, $R^8$ are mutually independently a $C_{1-4}$ alkyl residue, optionally hydroxy-substituted such as for example a hydroxyethyl residue, in particular a methyl residue. A preferred amine oxide is for example cocamidopropylamine oxide.

Sugar Surfactants

Sugar surfactants are known surface-active compounds, which include, for example, the sugar surfactant classes of alkyl glucose esters, aldobionamides, gluconamides (saccharic acid amides), glycerol amides, glycerol glycolipids, polyhydroxyfatty acid amide sugar surfactants (sugar amides) and alkyl polyglycosides. Sugar surfactants which are preferred for the purposes of the teaching according to the invention are alkyl polyglycosides and sugar amides and the derivatives thereof, in particular the ethers and esters thereof. The ethers are the products arising from the reaction of one or more, preferably one, sugar hydroxyl group with a compound containing one or more hydroxyl groups, for example $C_{1-22}$ alcohols or glycols such as ethylene glycol and/or propylene glycol, in which the sugar hydroxyl group may also bear polyethylene glycol and/or polypropylene glycol residues. The esters are the reaction products of one or more, preferably one, sugar hydroxyl group with a carboxylic acid, in particular a $C_{6-22}$ fatty acid.

Sugar Amides

Particularly preferred sugar amides comply with the formula R'C(O)N(R")[Z], in which R' denotes a linear or branched, saturated or unsaturated acyl residue, preferably a linear unsaturated acyl residue, with 5 to 21, preferably 5 to 17, in particular 7 to 15, particularly preferably 7 to 13 carbon atoms, R" denotes a linear or branched, saturated or unsaturated alkyl residue, preferably a linear unsaturated alkyl residue, with 6 to 22, preferably 6 to 18, in particular 8 to 16, particularly preferably 8 to 14 carbon atoms, a $C_{1-5}$ alkyl residue, in particular a methyl, ethyl, propyl, isopropyl, n-butyl, isobutyl, tert.-butyl or n-pentyl residue, or hydrogen and Z denotes a sugar residue, i.e. a monosaccharide. Particularly preferred sugar amides are the amides of glucose, the glucamides, for example lauroyl methyl glucamide.

Alkyl Polyglycosides

Alkyl polyglycosides (APGs) are sugar surfactants which are particularly preferred for the purposes of the teaching according to the invention and preferably comply with the general formula $R^iO(AO)_a[G]_x$, in which $R^i$ denotes a linear or branched, saturated or unsaturated alkyl residue with 6 to 22, preferably 6 to 18, in particular 8 to 16, particularly preferably 8 to 14 carbon atoms, [G] denotes a glycosidically linked sugar residue and x denotes a number from 1 to 10 and AO denotes an alkyleneoxy group, for example an ethyleneoxy or propyleneoxy group, and a denotes the average degree of alkoxylation from 0 to 20. The group $(AO)_a$ may here also contain different alkyleneoxy units, for example ethyleneoxy or propyleneoxy units, in which case a is then the average overall degree of alkoxylation, i.e. the sum of the degrees of ethoxylation and propoxylation. Unless stated otherwise or in greater detail below, the alkyl residues $R^i$ of the APGs are linear unsaturated residues with the stated number of carbon atoms.

APGs are nonionic surfactants and constitute known substances which may be obtained using relevant methods of preparative organic chemistry. The index value x indicates the degree of oligomerization (degree of polymerization), i.e. the distribution of mono- and oligoglycosides, and denotes a number between 1 and 10. While x must always be integral in a given compound and in this case may primarily assume the values x=1 to 6, the value x for a specific alkyl glycoside is a calculated value determined by analysis and is usually a fractional number. Preferably, alkyl glycosides with an average degree of oligomerization x of 1.1 to 3.0 are used. From an applicational standpoint, preferred alkyl glycosides are those whose degree of oligomerization is less than 1.7 and in particular is between 1.2 and 1.6. The glycosidic sugar used is preferably xylose, but in particular glucose.

The alkyl or alkenyl residue $R^i$ may be derived from primary alcohols having 8 to 18, preferably 8 to 14 carbon atoms. Typical examples are caproic alcohol, caprylic alcohol, capric alcohol and undecyl alcohol and the technical mixtures thereof, as arise, for example, from the hydrogenation of technical fatty acid methyl esters or in the course of hydrogenation of aldehydes from Roelen's oxo synthesis.

The alkyl or alkenyl residue $R^i$ is, however, preferably derived from lauryl alcohol, myristyl alcohol, cetyl alcohol, palmoleyl alcohol, stearyl alcohol, isostearyl alcohol or oleyl alcohol. Elaidyl alcohol, petroselinyl alcohol, arachidyl alcohol, gadoleyl alcohol, behenyl alcohol, erucyl alcohol and the technical mixtures thereof may furthermore be mentioned.

Particularly preferred APGs are non-alkoxylated (a=0) and comply with the formula $RO[G]_x$, in which, as previously, R denotes a linear or branched, saturated or unsaturated alkyl residue with 4 to 22 carbon atoms, [G] denotes a glycosidically linked sugar residue, preferably glucose residue, and x denotes a number from 1 to 10, preferably 1.1 to 3, in particular 1.2 to 1.6. Preferred alkyl polyglycosides are accordingly for example $C_{8-10}$ and a $C_{12-14}$ alkyl polyglucoside with a degree of polymerization of 1.4 or 1.5, in particular $C_{8-10}$-alkyl-1,5-glucoside and $C_{12-14}$-alkyl-1,4-glucoside.

Further Anionic Surfactants

The agent according to the invention may additionally contain one or more further anionic surfactants, conventionally in a quantity of 0.001 to 5 wt. %, preferably of 0.01 to 4 wt. %, in particular of 0.1 to 3 wt. %, particularly preferably of 0.2 to 2 wt. %, extremely preferably of 0.5 to 1.5 wt. %, for example of 1 wt. %.

Further suitable anionic surfactants are in particular aliphatic sulfates such as fatty alcohol sulfates, monoglyceride sulfates and ester sulfonates (sulfofatty acid esters), lignin sulfonates, alkylbenzene sulfonates, fatty acid cyanamides, anionic sulfosuccinic acid surfactants, fatty acid isethionates, acylamino alkanesulfonates (fatty acid taurides), fatty acid sarcosinates, ether carboxylic acids and alkyl (ether) phosphates.

Further suitable anionic surfactants also anionic gemini surfactants with a diphenyl oxide parent structure, 2 sulfonate groups and an alkyl residue on one or both benzene rings according to the formula $^{-}O_3S(C_6H_3R)O(C_6H_3R')SO_3^{-}$, in which R denotes an alkyl residue with for example 6, 10, 12 or 16 carbon atoms and R' denotes R or H (Dowfax® Dry Hydrotrope Powder with $C_{16}$ alkyl residue(s); INCI Sodium Hexyldiphenyl Ether Sulfonate, Disodium Decyl Phenyl Ether Disulfonate, Disodium Lauryl Phenyl Ether Disulfonate, Disodium Cetyl Phenyl Ether Disulfonate).

Anionic Sulfosuccinic Acid Surfactants

Particularly preferred further anionic surfactants are the anionic sulfosuccinic acid surfactants sulfosuccinates, sulfosuccinamates and sulfosuccinamides, in particular sulfosuccinates and sulfosuccinamates, extremely preferably sulfosuccinates. Sulfosuccinates comprise the salts of mono- and diesters of sulfosuccinic acid $HOOCCH(SO_3H)CH_2COOH$, while sulfosuccinamates are taken to mean the salts of the monoamides of sulfosuccinic acid and sulfosuccinamides are taken to mean the salts of the diamides of sulfosuccinic acid.

The salts preferably comprise alkali metal salts, ammonium salts and mono-, di- or trialkanolammonium salts, for example mono-, di- or triethanolammonium salts, in particular lithium, sodium, potassium or ammonium salts, particularly preferably sodium or ammonium salts, extremely preferably sodium salts.

In the sulfosuccinates, one or both of the carboxyl groups of the sulfosuccinic acid is/are preferably esterified with one or two identical or different unbranched or branched, saturated or unsaturated, acyclic or cyclic, optionally alkoxylated alcohols with 4 to 22, preferably 6 to 20, in particular 8 to 18, particularly preferably 10 to 16, extremely preferably 12 to 14 carbon atoms. Particularly preferred esters are those of unbranched and/or saturated and/or acyclic and/or alkoxylated alcohols, in particular unbranched, saturated fatty alcohols and/or unbranched, saturated fatty alcohols alkoxylated with ethylene oxide and/or propylene oxide, preferably ethylene oxide, with a degree of alkoxylation of 1 to 20, preferably of 1 to 15, in particular of 1 to 10, particularly preferably of 1 to 6, extremely preferably of 1 to 4. For the purposes of the present invention, the monoesters are preferred over the diesters. One particularly preferred sulfosuccinate is sulfosuccinic acid lauryl polyglycol ester disodium salt (lauryl EO sulfosuccinate, disodium salt; INCI Disodium Laureth Sulfosuccinate), which is commercially obtainable for example as Tego® Sulfosuccinate F 30 (Goldschmidt) with a sulfosuccinate content of 30 wt. %.

In the sulfosuccinamates or sulfosuccinamides, one or both of the carboxyl groups of the sulfosuccinic acid forms/form a carboxamide, preferably with a primary or secondary amine, which bears one or two identical or different, unbranched or branched, saturated or unsaturated, acyclic or cyclic, optionally alkoxylated alkyl residues with 4 to 22, preferably 6 to 20, in particular 8 to 18, particularly preferably 10 to 16, extremely preferably 12 to 14 carbon atoms. Unbranched and/or saturated and/or acyclic alkyl residues are particularly preferred, in particular unbranched, saturated fatty alkyl residues.

In one particular embodiment, the agent according to the invention contains as the anionic sulfosuccinic acid surfactants one or more sulfosuccinates, sulfosuccinamates and/or sulfosuccinamides, preferably sulfosuccinates and/or sulfosuccinamates, in particular sulfosuccinates, in a quantity of conventionally 0.001 to 5 wt. %, preferably of 0.01 to 4 wt. %, in particular of 0.1 to 3 wt. %, particularly preferably of 0.2 to 2 wt. %, extremely preferably of 0.5 to 1.5 wt. %, for example of 1 wt. %.

Further Amphoteric Surfactants

Amphoteric surfactants (amphosurfactants, zwitterionic surfactants) which may be used according to the invention include alkylamidoalkylamines, alkyl-substituted amino acids, acylated amino acids or biosurfactants, with alkylamidoalkylamines being preferred for the purposes of the teaching according to the invention.

Alkylamidoalkylamines

Alkylamidoalkylamines (INCI Alkylamido Alkylamines) are amphoteric surfactants of the formula (III), $$R^9—CO—NR^{10}—(CH_2)_i—N(R^{11})—(CH_2CH_2O)_j—(CH_2)_k—[CH(OH)]_l—CH_2—Z—OM \quad (III)$$

in which $R^9$ is a saturated or unsaturated $C_{6-22}$ alkyl residue, preferably $C_{8-18}$ alkyl residue, in particular a saturated $C_{10-16}$ alkyl residue, for example a saturated $C_{12-14}$ alkyl residue, $R^{10}$ is a hydrogen atom H or a $C_{1-4}$ alkyl residue, preferably H, i is a number from 1 to 10, preferably from 2 to 5, in particular 2 or 3, $R^{11}$ is a hydrogen atom H or $CH_2COOM$ (see below for M), j is a number from 1 to 4, preferably 1 or 2, in particular 1, k is a number from 0 to 4, preferably 0 or 1, l is 0 or 1, in which k=1 when l=1, Z is CO, $SO_2$, $OPO(OR^{12})$ or $P(O)(OR^{12})$, in which $R^{12}$ is a $C_{1-4}$ alkyl residue or M (see below), and M is a hydrogen, an alkali metal, an alkaline earth metal or a protonated alkanolamine, for example protonated mono-, di- or triethanolamine.

Preferred representatives comply with the formulae IIIa to IIId, $$R^9—CO—NH—(CH_2)_2—N(R^{11})—CH_2CH_2O—CH_2—COOM \quad (IIIa)$$

$$R^9—CO—NH—(CH_2)_2—N(R^{11})—CH_2CH_2O—CH_2CH_2—COOM \quad (IIIb)$$

$$R^9—CO—NH—(CH_2)_2—N(R^{11})—CH_2CH_2O—CH_2CH(OH)CH_2—SO_3M \quad (IIIc)$$

$$R^9—CO—NH—(CH_2)_2—N(R^{11})—CH_2CH_2O—CH_2CH(OH)CH_2—OPO_3HM \quad (IIId)$$

in which $R^{11}$ and M have the same meaning as in the formula (III).

Alkyl-Substituted Amino Acids

Alkyl-substituted amino acids (INCI Alkyl Substituted Amino Acids) which are preferred according to the invention are monoalkyl-substituted amino acids according to the formula (IV), $$R^{13}—NH—CH(R^{14})—(CH_2)_u—COOM' \quad (IV)$$

in which $R^{13}$ is a saturated or unsaturated $C_{6-22}$ alkyl residue, preferably $C_{8-18}$ alkyl residue, in particular a saturated $C_{10-16}$ alkyl residue, for example a saturated $C_{12-14}$ alkyl residue, $R^{14}$ is a hydrogen atom H or a $C_{1-4}$ alkyl residue, preferably H, u is a number from 0 to 4, preferably 0 or 1, in particular 1, and M' is a hydrogen, an alkali metal, an alkaline earth metal or a protonated alkanolamine, for example protonated mono-, di- or triethanolamine, alkyl-substituted imino acids according to the formula (V), $$R^{15}—N—[(CH_2)_v—COOM'']_2 \quad (V)$$

in which $R^{15}$ is a saturated or unsaturated $C_{6-22}$ alkyl residue, preferably $C_{8-18}$ alkyl residue, in particular a saturated $C_{10-16}$ alkyl residue, for example a saturated $C_{12-14}$ alkyl residue, v is a number from 1 to 5, preferably 2 or 3, in particular 2, and M'' is a hydrogen, an alkali metal, an alkaline earth metal or a protonated alkanolamine, for example protonated mono-, di- or triethanolamine, in which M'' in the two carboxy groups may have the same or two different meanings, for example hydrogen and sodium or sodium in both cases, and mono- or dialkyl-substituted natural amino acids according to the formula (VI), $$R^{16}—N(R^{17})—CH(R^{18})—COOM''' \quad (VI)$$

in which $R^{16}$ is a saturated or unsaturated $C_{6-22}$ alkyl residue, preferably $C_{8-18}$ alkyl residue, in particular a saturated $C_{10-16}$ alkyl residue, for example a saturated $C_{12-14}$ alkyl residue, $R^{17}$ is a hydrogen atom, or a $C_{1-4}$ alkyl residue, optionally hydroxy- or amine-substituted, for example a methyl, ethyl, hydroxyethyl or aminopropyl residue, $R^{18}$ is the residue of one of the 20 natural α-amino acids $H_2NCH(R^{18})COOH$, and M''' is a hydrogen, an alkali metal, an alkaline earth metal or a protonated alkanolamine, for example a protonated mono-, di- or triethanolamine.

Particularly preferred alkyl-substituted amino acids are the aminopropionates according to the formula (IVa), $$R^{13}—NH—CH_2CH_2COOM' \quad (IVa)$$

in which $R^{13}$ and M' have the same meaning as in the formula (IV).

Acylated Amino Acids

Acylated amino acids are amino acids, in particular the 20 natural α-amino acids, which bear on the amino nitrogen atom the acyl residue $R^{19}CO$ of a saturated or unsaturated fatty acid $R^{19}COOH$, in which $R^{19}$ is a saturated or unsaturated $C_{6-22}$ alkyl residue, preferably $C_{8-18}$ alkyl residue, in particular a saturated $C_{10-16}$ alkyl residue, for example a saturated $C_{12-14}$ alkyl residue. The acylated amino acids may also be used as an alkali metal salt, alkaline earth metal salt or alkanolammonium salt, for example mono-, di- or triethanolammonium salt. Acylated amino acids which may be mentioned by way of example are the acyl derivatives described according to INCI nomenclature among Amino Acids, for example Sodium Cocoyl Glutamate, Lauroyl Glutamic Acid, Capryloyl Glycine or Myristoyl Methylalanine.

Amphoteric Surfactant Combinations

One particular embodiment of the invention uses a combination of two or more different amphoteric surfactants, in particular a binary amphoteric surfactant combination. The amphoteric surfactant combination preferably contains at least one betaine, in particular at least one alkylamidobetaine, particularly preferably cocamidopropylbetaine.

The amphoteric surfactant combination furthermore preferably contains at least one amphoteric surfactant from the group comprising sodium carboxyethyl cocophosphoethylimidazoline (Phosphoteric® TC-6), $C_{8/10}$ amidopropylbetaine (INCI Capryl/Capramidopropyl Betaine; Tego® Betaine 810), N-2-hydroxyethyl-N-carboxymethyl fatty acid amidoethylamine Na (Rewoteric® AMV) and N-caprylic/capric amidoethyl N-ethyl ether propionate Na (Rewoteric® AMVSF) together with the betaine 3-(3-cocamidopropyl)-dimethyl-ammonium 2-hydroxypropanesulfonate (INCI Sultaine; Rewoteric® AM CAS) and the alkylamidoalkylamine N-[N'(N''-2-hydroxyethyl-N''-carboxyethyl-amino-ethyl)-acetamido]-N,N-dimethyl-N-cocosammoniumbetaine (Rewoteric® QAM 50), in particular together with cocamidopropylbetaine.

In a further particular embodiment, the agent according to the invention contains one or more amphoteric surfactants in a quantity of more than 8 wt. %. In still another particular embodiment, the agent according to the invention contains one or more amphoteric surfactants in a quantity of less than 2 wt. %.

Cationic Surfactants

The agent according to the invention may additionally contain one or more cationic surfactants, conventionally in a quantity of 0.001 to 5 wt. %, preferably of 0.01 to 4 wt. %, in particular of 0.1 to 3 wt. %, particularly preferably of 0.2 to 2 wt. %, extremely preferably of 0.5 to 1.5 wt. %, for example of 1 wt. %.

Preferred cationic surfactants are quaternary surface-active compounds, in particular having an ammonium, sulfonium, phosphonium, iodonium or arsonium group, which are also known as antimicrobial active ingredients. By using quaternary surface-active compounds having an antimicrobial action, it is possible to provide the agent with an antimicrobial action or to improve any antimicrobial action which it may already have due to other ingredients.

Particularly preferred cationic surfactants are the quaternary ammonium compounds (QAC; INCI Quaternary Ammonium Compounds) of the general formula $(R^{I})(R^{II})(R^{III})(R^{IV})N^{+}X^{-}$, in which $R^{I}$ to $R^{IV}$ represent identical or different $C_{1-22}$ alkyl residues, $C_{7-28}$ aralkyl residues or heterocyclic residues, in which two or, in the case of aromatic incorporation as in pyridine, even three residues form the heterocycle together with the nitrogen atom, for example a pyridinium or imidazolinium compound, and $X^{-}$ are halide ions, sulfate ions, hydroxide ions or similar anions. To ensure optimum antimicrobial action, at least one of the residues preferably has a chain length of 8 to 18, in particular of 12 to 16, C atoms.

QACs may be produced by reacting tertiary amines with alkylating agents, such as for example methyl chloride, benzyl chloride, dimethyl sulfate, dodecyl bromide, and also ethylene oxide. Alkylation of tertiary amines with a long alkyl residue and two methyl groups is particularly easy, and the quaternization of tertiary amines with two long residues and a methyl group may be performed with the assistance of methyl chloride under mild conditions. Amines which have three long alkyl residues or hydroxy-substituted alkyl residues are not very reactive and are preferably quaternized with dimethyl sulfate.

Suitable QACs are for example benzalkonium chloride (N-alkyl-N,N-dimethylbenzylammonium chloride, CAS No. 8001-54-5), Benzalkon B (m,p-dichlorobenzyl dimethyl-$C_{12}$-alkylammonium chloride, CAS No. 58390-78-6), benzoxonium chloride (benzyldodecylbis-(2-hydroxyethyl)ammonium chloride), cetrimonium bromide (N-hexadecyl-N,N-trimethylammonium bromide, CAS No. 57-09-0), benzetonium chloride (N,N-dimethyl-N-[2-[2-[p-(1,1,3,3-tetramethyl-butyl)phenoxy]ethoxy]ethyl]-benzylammonium chloride, CAS No. 121-54-0), dialkyldimethylammonium chlorides such as di-n-decyldimethylammonium chloride (CAS No. 7173-51-5-5), didecyldimethylammonium bromide (CAS No. 2390-68-3), dioctyldimethylammonium chloride, 1-cetylpyridinium chloride (CAS No. 123-03-5) and thiazoline iodide (CAS No. 15764-48-1) and mixtures thereof. Preferred QACs are benzalkonium chlorides with $C_8$-$C_{18}$ alkyl residues, in particular $C_{12}$-$C_{14}$ alkylbenzyl-dimethylammonium chloride. One particularly preferred QAC is cocopentaethoxymethyl-ammonium methosulfate (INCI PEG-5 Cocomonium Methosulfate; Rewoquat® CPEM).

In order to avoid possible incompatibilities of the cationic surfactants with the anionic surfactants present according to the invention, the cationic surfactants used are those which are as highly compatible with anionic surfactants and/or are as slightly cationic as possible or, in one particular embodiment of the invention, cationic surfactants are completely omitted.

Water-Soluable Salts

The cleaning agent according to the invention furthermore contains one or more water-soluble salts. These may comprise inorganic and/or organic salts; in a preferred embodiment the agent contains at least one inorganic salt.

Inorganic salts which may be used according to the invention are preferably selected from the group comprising colorless water-soluble halides, sulfates, sulfites, carbonates, hydrogencarbonates, nitrates, nitrites, phosphates and/or oxides of alkali metals, alkaline earth metals, of aluminium and/or the transition metals; ammonium salts may furthermore be used. Halides and sulfates of alkali metals are particularly preferred; the inorganic salt is therefore preferably selected from the group comprising sodium chloride, potassium chloride, sodium sulfate, potassium sulfate and mixtures thereof. Sodium chloride is used in a preferred embodiment.

The organic salts usable according to the invention in particular comprise colorless water-soluble alkali metal, alkaline earth metal, ammonium, aluminium and/or transition metal salts of carboxylic acids. The salts are preferably selected from the group comprising formate, acetate, propionate, citrate, malate, tartrate, succinate, malonate, oxalate, lactate and mixtures thereof.

The cleaning agent according to the invention preferably contains 10 to 40 wt. %, particularly preferably 15 to 30 wt. % of at least one water-soluble salt. It must be ensured that the salt concentration in the cleaning agent according to the invention is so high that the salt does not pass completely into solution, i.e. the saturation point is exceeded. A preferred salt is furthermore one having water solubility which varies only slightly over wide temperature range.

In one particularly preferred embodiment, solely inorganic salts are used, very particularly preferably sodium chloride.

Solvents

The water content of the aqueous agent according to the invention conventionally amounts to 15 to 60 wt. %, preferably 20 to 50 wt. %.

The agent according to the invention may advantageously additionally contain one or more water-soluble organic solvents, conventionally in a quantity of 0.1 to 10 wt. %, preferably of 1 to 8 wt. %.

For the purposes of the teaching according to the invention, the solvent is in particular used as a hydrotropic agent, viscosity regulator and/or low-temperature stabilizer. It has a solubilizing action, prevents the formation of liquid crystalline phases and contributes to the formation of clear products. The viscosity of the agent according to the invention falls as the quantity of solvent increases. Too much solvent may, however, bring about an excessive reduction in viscosity. Finally, the low temperature cloud point and clear point of the agent according to the invention falls as the amounts of solvent increases.

Suitable solvents are for example saturated or unsaturated, preferably saturated, branched or unbranched $C_{1-20}$ hydrocarbons, preferably $C_{2-15}$ hydrocarbons, with at least one hydroxyl group and optionally one or more C—O—C ether functions, i.e. oxygen atoms interrupting the carbon atom chain.

Preferred solvents are $C_{2-6}$ alkylene glycols, optionally etherified on one side with a $C_{1-6}$ alkanol, and poly-$C_{2-3}$-alkylene glycol ethers having on average 1 to 9 identical or different, preferably identical, alkylene glycol groups per molecule, as well as $C_{1-6}$ alcohols, preferably ethanol, n-propanol or iso-propanol, in particular ethanol.

Particularly preferred solvents are the poly-$C_{2-3}$-alkylene glycol ethers etherified on one side with a $C_{1-6}$ alkanol and having on average 1 to 9, preferably 2 to 3, ethylene glycol or propylene glycol groups, for example PPG-2 Methyl Ether (dipropylene glycol monomethyl ether).

The solvent is preferably selected from the group comprising methanol, ethanol, propanol, isopropanol, ethylene glycol, propylene glycol and mixtures thereof.

Extremely preferred solvents are the $C_{2-3}$ alcohols ethanol, n-propanol and/or iso-propanol, in particular ethanol.

Solubilizing agents other than the above-described solvents which may in particular be used for perfume and colorants are, for example, also alkanolamines and alkylbenzene sulfonates having 1 to 3 carbon atoms in the alkyl residue.

Further Ingredients

In addition to the previously stated components, the agents according to the invention may contain further ingredients. These include for example further surfactants, water-insoluble organic and/or inorganic abrasives, additives for improving draining and drying behavior, for adjusting viscosity, for stabilization and further auxiliary substances and additives conventional in manual dishwashing agents, for instance UV stabilizers, perfume, pearlescent agents, colorants, corrosion inhibitors, preservatives, bitter substances, organic salts, disinfectants, enzymes, structure-imparting polymers, defoamers, encapsulated ingredients (for example encapsulated perfume, enzymes), pH adjusting agent and skin feel-improving or conditioning additives.

Additives

In order further to improve draining and/or drying behavior, the agent according to the invention may contain one or more additives from the group of surfactants, polymers and builder substances (builders), conventionally in a quantity of 0.001 to 5 wt. %, preferably of 0.01 to 4 wt. %, in particular of 0.1 to 3 wt. %, particularly preferably of 0.2 to 2 wt. %, extremely preferably of 0.5 to 1.5 wt. %, for example of 1 wt. %.

In one particular embodiment of the invention, the stated additives are omitted.

Thickeners

The agent according to the invention may additionally contain one or more polymeric thickeners for thickening.

Polymeric thickeners for the purposes of the present invention are polycarboxylates which, as polyelectrolytes, have a thickening action, preferably homo- and copolymers of acrylic acid, in particular acrylic acid copolymers such as acrylic acid/methacrylic acid copolymers, and polysaccharides, in particular heteropolysaccharides, and other conventional thickening polymers.

Suitable polysaccharides or heteropolysaccharides are polysaccharide gums, for example gum arabic, agar, alginates, carrageenan and the salts thereof, guar, guaran, tragacanth, gellan, ramsan, dextran or xanthan and the derivatives thereof, for example propoxylated guar, and the mixtures thereof. Other polysaccharide thickeners, such as starches or cellulose derivatives, may however alternatively preferably be used in addition to a polysaccharide gum, for example starches of the most varied origin and starch derivatives, for example hydroxyethyl starch, starch phosphate esters or starch acetates, or carboxymethylcellulose or the sodium salt thereof, methyl-, ethyl-, hydroxyethyl-, hydroxypropyl-, hydroxypropylmethyl- or hydroxyethylmethyl-cellulose or cellulose acetate.

Acrylic acid polymers suitable as polymeric thickeners are, for example, high molecular weight homopolymers of acrylic acid crosslinked with a polyalkenyl polyether, in particular an allyl ether of sucrose, pentaerythritol or propylene (INCI Carbomer), which are also known as carboxyvinyl polymers.

Particularly suitable polymeric thickeners are, however, the following acrylic acid copolymers: (i) copolymers of two or more monomers from the group of acrylic acid, methacrylic acid and the simple esters thereof, preferably formed with $C_{1-4}$ alkanols (INCI Acrylates Copolymer), which include for instance the copolymers of methacrylic acid, butyl acrylate and methyl methacrylate (CAS 25035-69-2) or of butyl acrylate and methyl methacrylate (CAS 25852-37-3); (ii) crosslinked high molecular weight acrylic acid copolymers, which include for instance the copolymers, crosslinked with an allyl ether of sucrose or of pentaerythritol, of $C_{10-30}$ alkyl acrylates with one or more monomers from the group of acrylic acid, methacrylic acid and the simple esters thereof, preferably formed with $C_{1-4}$ alkanols (INCI Acrylates/C10-30 Alkyl Acrylate Crosspolymer).

The content of polymeric thickeners conventionally amounts to no more than 8 wt. %, preferably between 0.1 and 7 wt. %, particularly preferably between 0.5 and 6 wt. %, in particular between 1 and 5 wt. % and extremely preferably between 1.5 and 4 wt. %, for example between 2 and 2.5 wt. %.

In a preferred embodiment of the invention, however, the agent contains no polymeric thickeners.

Dicarboxylic Acid (Salts)

In order to stabilize the agent according to the invention, in particular in the case of an elevated surfactant content, one or more dicarboxylic acids and/or the salts thereof may be added, in particular a composition of the sodium salts of adipic, succinic and glutaric acid, as is for example obtainable under the trade name Sokalan® DSC. Addition is here advantageously made in quantities of 0.1 to 8 wt. %, preferably of 0.5 to 7 wt. %, in particular of 1.3 to 6 wt. % and particularly preferably of 2 to 4 wt. %.

Modifying the dicarboxylic acid (salt) content may, in particular in quantities of above 2 wt. %, assist in providing a clear solution of the ingredients. It is likewise possible within certain limits to influence the viscosity of the mixture by this agent. This component furthermore has an influence on the solubility of the mixture. This component is particularly preferably used at elevated surfactant contents, in particular at surfactant contents above 30 wt. %.

Use thereof may, however, be dispensed with, in which case the agent according to the invention preferably contains no dicarboxylic acid(s)/dicarboxylic acid salt(s).

Auxiliary Substances and Additives

One or more further auxiliary substances and additives which are conventional, in particular in manual dishwashing agents and cleaning agents for hard surfaces, may additionally be present, in particular UV stabilizers, perfume, pearlescent agents (INCI Opacifying Agents; for example glycol distearate, for example Cutina® AGS from Cognis, or mixtures containing this, for example Euperlane® from Cognis), colorants, corrosion inhibitors, preservatives (for example 2-bromo-2-nitropropane-1,3-diol (CAS 52-51-7), which is also known industrially as Bronopol and is commercially obtainable for example Myacide® BT or as Boots Bronopol BT from Boots), organic salts, disinfectants, enzymes, pH adjusting agents and skin feel-improving or skin-conditioning additives (for example dermatologically effective substances such as vitamin A, vitamin B2, vitamin B12, vitamin C, vitamin E, D-panthenol, sericerin, collagen partial hydrolysate, various plant protein partial hydrolysates, protein hydrolysate/fatty acid condensation products, liposomes, cholesterol, plant and animal oils such as for example lecithin, soy oil, etc., plant extracts such as for example Aloe vera, azulene, witch hazel extracts, algae extracts, etc., allantoin, AHA complexes, glycerol, urea, quaternized hydroxyethylcellulose), in quantities of conventionally no more than 5 wt. %.

pH Value

The pH value of the agent according to the invention may be established by means of conventional pH regulators, for example acids such as mineral acids or citric acid and/or alkalis such as sodium or potassium hydroxide, in which, in particular where hand compatibility is desired, a range from 4 to 9, preferably 5 to 8, in particular 5.5 to 7.5, is preferred.

In order to establish and/or stabilize the pH value, the agent according to the invention may contain one or more buffer substances (INCI Buffering Agents), conventionally in quantities of 0.001 to 5 wt. %, preferably of 0.005 to 3 wt. %, in particular of 0.01 to 2 wt. %, particularly preferably of 0.05 to 1 wt. %, extremely preferably of 0.1 to 0.5 wt. %, for example of 0.2 wt. %. Preferred buffer substances are those which are simultaneously complexing agents or even chelating agents (chelators, INCI Chelating Agents). Particularly preferred buffer substances are citric acid or citrates, in particular sodium and potassium citrates, for example trisodium citrate.$2H_2O$ and tripotassium citrate.$H_2O$.

Use

The agent according to the invention may be used for cleaning hard surfaces, in particular for manual dishwashing. Due to the surfactant combination it contains, it is distinguished in such use by good draining and drying behavior, while thanks to the abrasive action of the salts which are present it additionally has very good cleaning performance even on stubborn and baked-on soiling, and finally it also possesses elevated skin compatibility.

EXAMPLES

Seven formulations according to the invention were produced, the compositions of which may be found in the following table. Quantities are stated in wt. %. The resultant manual dishwashing agents were stable, pourable and readily dispensable and exhibit good cleaning, draining and drying behavior. A comparison formulation Comparison 1 was also produced, which was similar in composition to Invention 7 but contained no sodium chloride.

| | Invention 1 | Invention 2 | Invention 3 | Invention 4 | Invention 5 | Invention 6 | Invention 7 |
|---|---|---|---|---|---|---|---|
| Fatty alcohol ether sulfate | 10.00 | 13.33 | 12.00 | 12.00 | 13.30 | 13.30 | 13.30 |
| Cocamidopropylbetaine | 2.50 | 3.33 | 3.10 | 3.10 | 3.00 | 3.00 | 3.00 |
| Sec. alkanesulfonate | 2.50 | 3.33 | 2.90 | 2.90 | 3.70 | 3.70 | 3.70 |

-continued

| | Invention 1 | Invention 2 | Invention 3 | Invention 4 | Invention 5 | Invention 6 | Invention 7 |
|---|---|---|---|---|---|---|---|
| Fatty alcohol ethoxylate | 9.00 | 6.00 | — | — | — | — | — |
| Sodium chloride | 24.00 | 24.00 | 22.00 | 24.00 | 20.00 | 24.00 | 20.00 |
| Ethanol | — | — | 2.00 | 2.00 | 2.50 | 2.50 | 4.00 |
| Perfume | 0.20 | 0.30 | 0.30 | 0.30 | 0.30 | 0.30 | 0.30 |
| Colorant | 0.20 | 0.20 | 0.20 | 0.20 | 0.20 | 0.20 | 0.20 |
| Water | 51.60 | 49.51 | 57.50 | 55.50 | 57.00 | 53.00 | 55.50 |

Cleaning performance was tested by placing in each case 0.15 g of spaghetti sauce as test soiling onto plates and baking it for 2.5 hours at 160° C. 5 g of the product to be tested were then applied and rubbed in for 180 seconds with a rotary motion, a defined pressure being applied. Finally, the plate treated in this manner was inspected visually. It was found that all the agents according to the invention, Invention 1 to Invention 7, exhibited greatly improved cleaning performance on this stubborn, baked-on soiling. For instance, over 95% of the soiling was removed with Invention 7, while Comparison 1 achieved only 5% cleaning.

The agents according to the invention additionally exhibited improved skin compatibility compared with the comparison agent Comparison 1.

An elbow washing test was performed to test skin compatibility, formulations Invention 7 and Comparison 1 in each case being applied in 25% dilution. The test subjects themselves applied the formulations to their elbows 2× daily for a total of 6 minutes on each occasion. The skin reaction was assessed in each case before the next application. The elbow skin was investigated before and after the test by measuring skin moisture and barrier function (TEWL). No skin cream was applied to the area of application over the entire test period.

The comparison agent Comparison 1 induced slight to very severe scaling, slight to very severe erythema (reddening) and slight cracking. The test subjects additionally frequently reported itching, burning and a sensation of tightness both during and after washing.

Invention 7, in contrast, brought about only slight and moderate scaling, slight to severe erythema and no cracking. Isolated cases of itching, burning and tightness were reported, more frequently during washing than between washing.

Measurement of skin moisture revealed a reduction in moisture, accompanied by an increase in TEWL, for both products.

The overall outcome was that, in comparison with Comparison 1, the skin compatibility of Invention 7 was significantly better. This is indicated by the distinctly larger number and greater severity of skin reactions and by the more distinct increase in the TEWL value on the side treated with Comparison 1.

Retention of the agent in the sponge ("sponge load") was determined by the following method:

5 g of the cleaning agent to be tested were applied onto a water-soaked sponge. The sponge was then pressed once with a defined force, so distributing the agent in the sponge. 100 ml of water were then uniformly poured over the sponge and the liquid which passed through was collected. The quantity of surfactants eluted from the sponge laden with cleaning agent and contained in this liquid was determined by analysis and the difference relative to the previously calculated surfactant content of the applied cleaning agent was calculated in order to determine the quantity of surfactant still remaining in the sponge.

It was found that 80 to 95% of the surfactants remained in the sponge in the case of the cleaning agent according to the invention, while only 40 to 50% of the surfactants in the salt-free comparison formulation were still in the sponge. The ingredients with a cleaning action are accordingly retained in the sponge longer and in a greater quantity.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. An aqueous cleaning agent for hard surfaces, comprising:

a surfactant combination of fatty alcohol ether sulfate and at least one further surfactant, the at least one further surfactant including at least one betaine surfactant and at least one secondary alkanesulfonate such that the fatty alcohol ether sulfate, the secondary alkanesulfonate, and the betaine surfactant are included at a ratio of 2-5:up to 1:1;

at least one organic solvent selected from the group consisting of methanol, ethanol, iso-propanol, n-propanol, ethylene glycol, propylene glycol and mixtures thereof, in quantities ranging between 0.1 and 10 wt. %, and 15 to 40 wt. % of at least one halide of an alkali metal.

2. The aqueous cleaning agent according to claim 1, wherein the further surfactant also includes a nonionic surfactant that is selected from the group of consisting of fatty alcohol polyglycol ethers.

3. The aqueous cleaning agent according to claim 1, wherein the fatty alcohol ether sulfate is present in a quantity ranging between 5 and 20 wt. %.

4. The aqueous cleaning agent according to claim 1, wherein the secondary alkanesulfonate is present in a quantity ranging between 1 and 10 wt. %.

5. The aqueous cleaning agent according to claim 1, wherein the betaine surfactant is present in a quantity ranging between 1 and 10 wt. %.

6. The aqueous cleaning agent according claim 1, wherein the further surfactant comprises a fatty alcohol polyglycol ether in a quantity ranging between 0.001 and 10 wt. %.

7. The aqueous cleaning agent according to claim 1, wherein the at least one halide of an alkali metal is present in a quantity ranging between 15 and 30 wt. %.

8. The aqueous cleaning agent according to claim 1, further comprising one or more ingredients selected from the group consisting of further surfactants, water-insoluble organic and/or inorganic abrasives, bases, acids, viscosity modifiers, fatty acids, solvents, further polymers, antibacterial active ingredients, preservatives, bitter substances, solubilizing agents, complexing agents, enzymes, colorants, scents, pearlescent agents, stabilizers, pH adjusting agents, skin feel-improving or skin-conditioning additives and mixtures thereof.

* * * * *